US005806493A

United States Patent [19]

Kubo et al.

[11] Patent Number: 5,806,493

[45] Date of Patent: Sep. 15, 1998

[54] DISTRIBUTOR TYPE FUEL INJECTION PUMP

[75] Inventors: Kenichi Kubo; Mitsunori Urano; Toru Yokota; Jun Matsubara, all of Higashimatsuyama, Japan

[73] Assignee: Zexel Corporation, Tokyo, Japan

[21] Appl. No.: 977,239

[22] Filed: Nov. 24, 1997

[30] Foreign Application Priority Data

Nov. 28, 1996 [JP] Japan ..... 8-332695

[51] Int. Cl.[6] ..... F02M 37/04

[52] U.S. Cl. ..... 123/450; 123/495

[58] Field of Search ..... 123/450, 502, 123/449, 495; 417/228, 462, 366, 273

[56] References Cited

U.S. PATENT DOCUMENTS

| | | | |
|---|---|---|---|
| 2,515,033 | 7/1950 | Connor | 417/228 |
| 2,716,944 | 9/1955 | Ferris | 417/228 |
| 4,430,047 | 2/1984 | Ilg | 47/273 |
| 4,915,592 | 4/1990 | Hishinuma | 417/462 |
| 5,613,839 | 3/1997 | Buckley | 123/450 |
| 5,619,970 | 4/1997 | Collingborn | 123/450 |
| 5,619,971 | 4/1997 | Kubo | 123/450 |
| 5,666,921 | 9/1997 | Collingborn | 123/450 |

*Primary Examiner*—Carl S. Miller

*Attorney, Agent, or Firm*—Wenderoth, Lind & Ponack, L.L.P.

[57] ABSTRACT

In an inner-cam system fuel injection pump, two balance ports that are offset symmetrically relative to a distribution port in a circumferential direction to form a Y-shape are formed at a rotor. The opening ends of the balance ports and the opening end of the distribution port are positioned on the same plane that is perpendicular to the axis of the rotor. The offset angle θ by which the balance ports are offset in the circumferential direction relative to the axis of the distribution port, the opening area $S_1$ of the distribution port and the opening area $S_2$ of each of the balance ports are set to satisfy a relationship expressed as $S_1=|2\cdot S_2\cdot\cos\theta|$. The phase intervals of the fuel delivery passages and the phase interval of the two balance ports are set equal to each other. Seizure at the area where the rotor slides in contact with its supporting member is prevented effectively and stable injection characteristics are achieved by equalizing the residual pressures in the individual fuel delivery passages.

11 Claims, 4 Drawing Sheets

DISTRIBUTOR TYPE FUEL INJECTION PUMP

BACKGROUND OF THE INVENTION

1. Field of the Invention

The present invention relates to a distributor type fuel injection pump that force feeds compressed fuel from a distribution port into fuel delivery passages that are capable of communicating with the distribution port, by causing plungers to make reciprocal movement in the direction of the radius of a rotor that rotates in synchronization with an engine to vary the volumetric capacity of a compression space formed at the rotor with the plungers.

2. Description of the Related Art

Since seizure in the area where a rotor and a member supporting the rotor come in sliding contact with each other poses a problem in this type of distributor type fuel injection pump, in the development of which this applicant has been engaged, the technology disclosed in (0064)~(0066) (column 13, line 47 to column 14, line 42) of Japanese Unexamined Patent Publication No. H8-61180, has been proposed by the applicant of the present invention as a means for preventing such seizure.

Namely, two ports (64, 65: in the Publication) for achieving a balance of pressure in the direction of the radius are formed at a rotor that rotates in synchronization with an engine, with the opening ends of ports (64, 65) made to open at a sliding contact surface of the rotor where it comes in sliding contact with its supporting member provided aligned in the axial direction with the position of the opening end of a distribution port. The two ports (64, 65) and the distribution port (33) are all connected to a longitudinal hole (30) extending from a compression space so that when they are viewed in the axial direction of the rotor they form a Y-shape, to achieve a balance between the pressure applied in the direction of the radius imparted by the compressed fuel induced to the distribution port and the pressure applied in the direction of the radius imparted by the compressed fuel induced to the two ports (64, 65), thereby preventing seizure at the sliding contact surface.

While it has already been confirmed that seizure of the rotor and its supporting member is reduced by forming ports for achieving pressure balance at positions aligned to the position of the opening end of the distribution port in the axial direction, it is further required that the optimal shape of the balance ports be determined in order to achieve an injection pump that provides good durability and practicality.

In addition, it is desirable to maintain consistency in the residual pressures in the individual fuel delivery passages during a non-injection period during which the distribution passage becomes disengaged from the fuel delivery passages in order to achieve consistent injection characteristics. In order to ensure this, a pressure equalizing port that communicates between the distribution port and the chamber is formed at the surface of the rotor in the prior art as disclosed in No. 47 of Japanese Unexamined Patent Publication No. H7-269439, in FIG. 1 of Japanese Unexamined Patent Publication No. H7-247931 and the like. However, if balance ports are formed at the distribution port as described above, further providing the rotor with a pressure equalizing port will complicate the structure of the rotor, which causes a concern in that, because of their positions, the pressure equalizing port and the balance ports may interfere with each other.

SUMMARY OF THE INVENTION

Accordingly, an object of the present invention is to provide a distributor type fuel injection pump that achieves optimization in the shape of the balance ports and is ideal for practical use with improved durability through effective prevention of seizure at the area where the rotor and its supporting member come in sliding contact. Another object of the present invention is to provide a distributor type fuel injection pump that is capable of achieving stable injection characteristics by achieving consistency in the residual pressures in the individual fuel delivery passages at a specific level without having to form a separate pressure equalizing port.

On the premise that the rotor is provided with balance ports that form a Y-shape in relation to the distribution port, the inventor of the present invention conducted focused research into the optimal structure of the balance ports that achieves prevention of seizure at the area where the rotor and its supporting member come in sliding contact to a degree that allows the injection pump to be used in practical application and, at the same time, prevents inconsistency in the injection characteristics, which has culminated in the present invention.

Namely, the distributor type fuel injection pump according to the present invention comprises a rotor that rotates in synchronization with an engine, plungers that are provided slidably in the direction of the radius of the rotor to vary the volumetric capacity of a compression space formed at the rotor and a cam ring that is provided concentrically around the rotor to regulate the movement of the plungers, all of which are provided inside a housing, with ports for taking in, distributing and cutting off fuel by coming into communication with the compression space formed at the rotor and the distribution port opening at the area where the rotor and the member supporting the rotor come in sliding contact and being capable of communicating with fuel delivery passages that open at the sliding contact area. In this structure, balance ports that open at the sliding contact area and communicate with the compression space are provided at the rotor, and these balance ports consist of two ports that are symmetrically offset in the circumferential direction relative to the port for distributing fuel. These two balance ports and the distribution port are formed so that they form a Y-shape when viewed from the direction of the axis of the rotor, with the opening ends of the balance ports and the opening end of the distribution port positioned on the same plane which is perpendicular to the axis of the rotor. In addition, the balance ports are formed in such a manner that while the distribution port communicates with a fuel delivery passage, the balance ports do not communicate with any of the fuel delivery passages. The angle θ, which is the angle at which the balance ports are offset from the axis of the distribution port in the circumferential direction, the opening area $S_1$ of the distribution port and the opening area $S_2$ of each of the balance ports are set to satisfy a relationship expressed as $S_1=|2\cdot S_2\cdot\cos\theta|$.

Thus, while a reactive force expressed as (fuel pressure)× (opening area of the distribution port) is applied in the direction of the radius of the rotor (the opposite direction from the side where the distribution port is formed) when fuel is pressurized in the compression space at the rotor during a compression phase because of the increase in the pressure of the fuel filling the distribution port, a reactive force expressed as (fuel pressure)×(opening area of the balance port) is applied by each of the balance ports in the direction of the radius which is opposite from the balance ports because of the fuel filling the balance ports that are formed at the rotor and aligned with the distribution port in the axial direction. Since two balance ports are formed symmetrically relative to the distribution port in the direction of the circumference of the rotor to form a Y-shape and they are formed to ensure that the sum of the areas of the projected surfaces of the opening areas of the individual balance ports that extend parallel to the opening surface of the distribution port is equal to the opening area of the distribution port, the force applied toward the opposite side of the distribution port is canceled out by the combined resultant force of the forces generated at the balance ports. As a result, the rotor rotates in a well-balanced state in which it operates as though no forces were applied in any direction of the radius of the rotor so that the rotor slides against the rotor supporting number smoothly.

Furthermore, since the two balance ports and the distribution port are formed to constitute a Y-shape when viewed in the axial direction, the fuel pressure works at 3 locations around the rotor to achieve a more accurate pressure balance in the direction of the radius.

Furthermore, while the distribution port and the two balance ports are provided on the same plane which runs perpendicular to the axis of the rotor to form an overall Y-shape as explained above, since the balance ports do not communicate with any of the fuel delivery passages during the period of time over which the distribution port communicates with a fuel delivery passage, the compressed fuel can be supplied to the fuel delivery passages only through the distribution port and, consequently, the injection capacity is not affected.

In addition, when fuel delivery passages are formed by offsetting their phases over equal intervals, it is desirable to set the phase interval of the fuel delivery passages and the phase interval between the two balance ports equal to one another in order to achieve consistent injection characteristics. In such a structure, while one of the balance ports communicate with a fuel delivery passage, the other balance port will also communicates with another fuel delivery passage, thereby bringing the fuel delivery passages into communication with each other via the balance ports to eliminate inconsistency in the residual pressures in the fuel delivery passages. Furthermore, since, when the balance ports are communicating with the fuel delivery passages, the distribution port does not communicate with any of the fuel delivery passages and an intake phase is created during this period of time, the pressure of the fuel within the fuel delivery passages can be set equal to the pressure in the chamber by allowing the fuel delivery passages to communicate with the fuel chamber via the balance ports.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings.

DETAILED DESCRIPTION OF THE PREFERRED EMBODIMENTS

Figure 1:
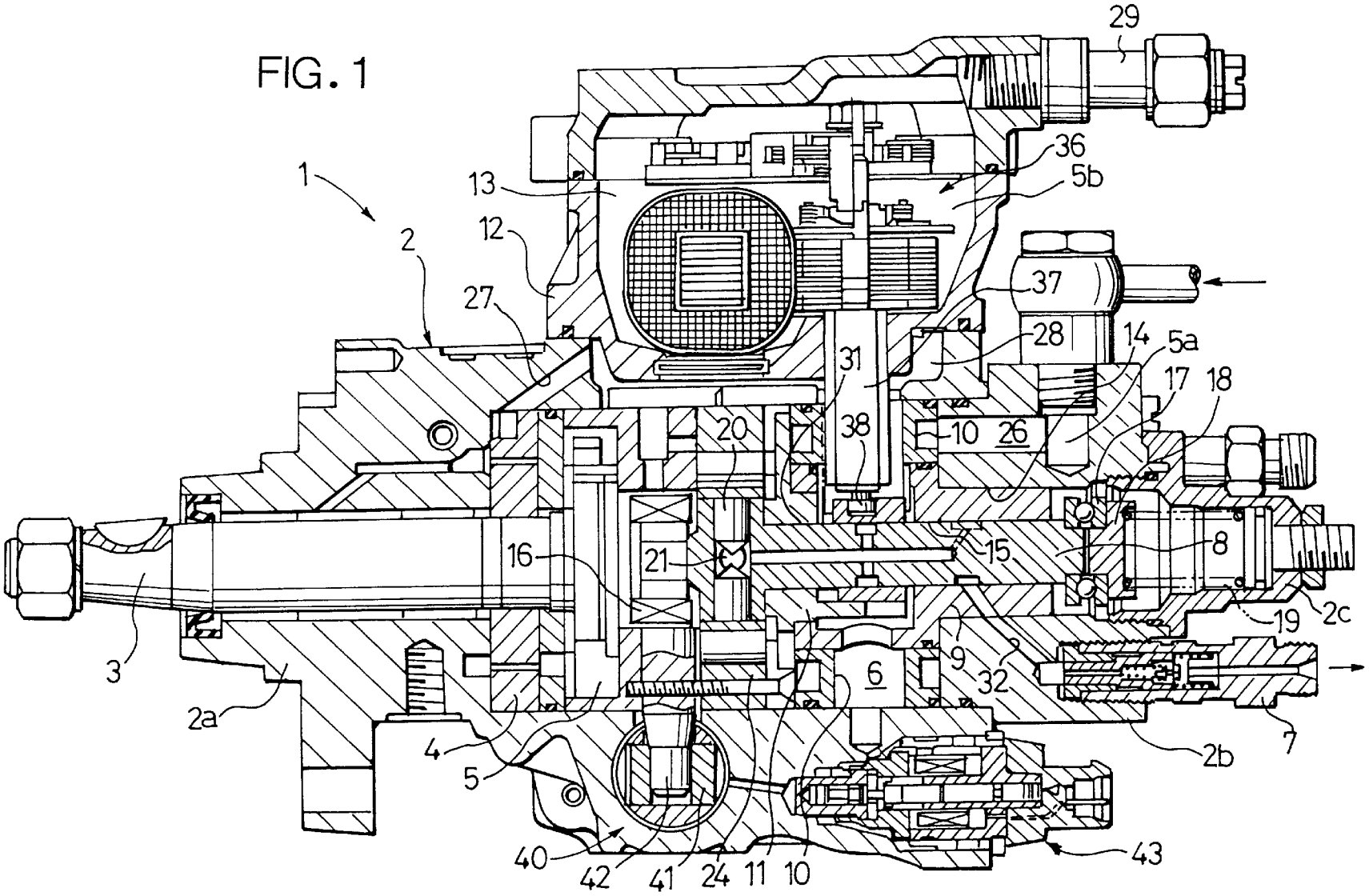
FIG. 1 is a cross section of the distributor type fuel injection pump according to the present invention.

The following is an explanation of an embodiment of the present invention in reference to the drawings. In FIG. 1, which illustrates a distributor type fuel injection pump employing an inner cam system, a drive shaft 3 is inserted in a pump housing 2 in a distributor type fuel injection pump 1, with one end of the drive shaft 3 projecting out of the pump housing 2 to receive drive torque from an engine (not shown) so that it rotates in synchronization with the engine (at a rotation rate half the rotation rate of the engine). The other end of the drive shaft 3 extends into the pump housing 2, and a feed pump 4 is linked to the drive shaft 3 so that fuel supplied via a low pressure fuel range 5*a* is then supplied to a fuel chamber 6 by the feed pump 4.

The pump housing 2 comprises a housing member 2*a*, in which the drive shaft 3 is inserted, a housing member 2*b* mounted at the housing member 2*a*, which is provided with delivery valves 7 and a housing member 2*c* that is provided on an extended line of a rotor 8 blocking off the opening portion of the housing member 2*b*. The fuel chamber 6 is constituted of the space enclosed by a rotor supporting member 9 provided inside the pump housing, a wall member 10 that holds the rotor supporting member 9 and an adapter 11 which is to be detailed later, and communicates with a governor storage chamber 13, the extent of which is defined by a governor housing 12. In addition, the rotor supporting member 9 is fitted in an insertion hole 14 formed at the housing member 2*b*, which provided with the delivery valves 7.

The rotor is rotatably supported at an insertion hole 15 formed at the rotor supporting member 9 with a high degree of oil-tightness, with its base end portion linked to the drive shaft 3 via a coupling 16 so that only the rotation that corresponds with the rotation of the drive shaft 3 is allowed. In addition, a spring 19 is provided between a spring receptacle 18 at the front end portion of the rotor 8 via a thrust bearing 17, and the housing member 2*c*, to apply a force to the rotor 8 toward the coupling to eliminate play in the axial direction.

Figure 2A:
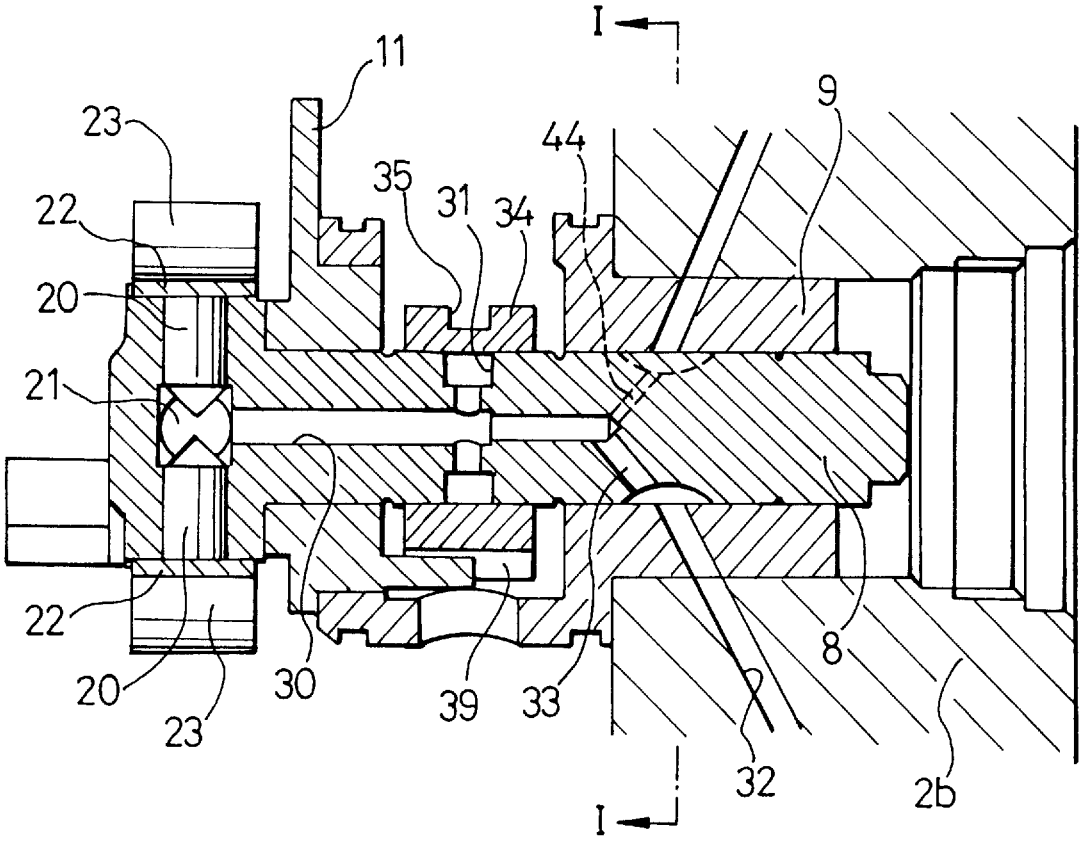
FIG. 2A is a cross section illustrating the rotor shown in FIG. 1 and its peripheral members, FIG. 2B, which is a cross section of the rotor and the rotor supporting member cut through line I—I, illustrates a structure in which there are four fuel delivery passages and FIG. 2C, which is a cross section of the rotor and the rotor supporting member cut through line I—I, illustrates a structure in which there are six fuel delivery passages.

At the base end portion of the rotor 8 that links with the drive shaft, plungers 20 are inserted slidably in the direction of the radius (radial direction) as shown in FIG. 2A. In this structural example, four plungers 20 are provided on the same plane over 90° intervals. The front end of each of the plungers 20 blocks off and faces a compression space 21 which is provided at the center of the base end portion of the rotor 8 and the base end of each plunger 20 slides in contact with the internal surface of a ring-like cam ring 24 via a shoe 22 and a roller 23. This cam ring is provided concentrically around the rotor 8, with cam surfaces, the number of which corresponds to the number of cylinders in the engine, formed on the inside so that when the rotor 8 rotates, each plunger 20 makes reciprocal movement in the direction of the radius of the rotor 8 (radial direction) to vary the volumetric capacity of the compression space 21.

In other words, the cam ring 24, which is formed to support four cylinders, is provided with projecting surfaces on the inside of the cam ring 24 over 90° intervals, and as a result, the four plungers 20 move together to perform compression by clamping the compression space 21 and withdraw together from the center of the cam ring 24.

The circular adapter 11 is externally fitted at the rotor 8 rotatably, with a portion of the circumferential edge of the adapter 11 retained by the cam ring 24 to restrict the rotation thereof so that it can only rotate together with the cam ring 24. In addition, the adapter 11 is fitted with the rotor supporting member 9 rotatably.

At the upper portion of the housing member 2*b*, a fuel inflow port 25 for inducing fuel from a fuel tank (not shown) is provided, and fuel flowing in through the fuel inflow port 25 is induced from a fuel supply passage 26 formed at the housing member 2*b* through the space formed around the wall member 10 and the adapter 11, the space formed between the cam ring 24 and the rotor 8 and the area surrounding the coupling 16 toward the intake side of the feed pump 4. These spaces and passages constitute the low pressure fuel range 5*a* ranging from the fuel inflow port 25 to the feed pump 4.

In addition, the fuel that has been compressed by the feed pump 4 travels via a passage 27 formed at the upper portion of the pump housing and a gap 28 formed between the pump housing 2 and the governor housing 12 mounted at the pump housing 2 to be guided toward the fuel chamber 6, and it is also guided via the governor storage chamber 13 to an overflow valve 29, with these communicating areas constituting a high pressure fuel range 5*b*.

At the rotor 8, a longitudinal hole 30 formed in the axial direction and communicating with the compression space 21, an inflow/outflow port 31 that communicates with the longitudinal hole 30 and opens at the circumferential surface of the rotor 8 and a distribution port 33 that allows fuel delivery passages 32 formed at the rotor supporting member 9 and the housing member 2*b* to communicate with the longitudinal hole 30 are provided. The inflow/outflow port 31 opens into the fuel chamber at the surface of the rotor 8 and this opening portion is covered by a control sleeve 34 which is externally fitted at the rotor 8 with a high degree of oil-tightness.

In the control sleeve 34, a communicating hole that is capable of communicating with the inflow/outflow port 31 is formed (not shown). This communicating hole is of the known art, having a shape whereby the timing with which it starts to communicate with the inflow/outflow port 31 can be varied by moving the control sleeve 34 in the axial direction (see Japanese Unexamined Patent Publication No. H8-61180 and the like).

A connecting groove 35 is formed over a specific angular range in the direction of the circumference at the upper surface of the control sleeve 34, and a lug 38 formed at the front end of a shaft 37 of an electric governor 36 is engaged in the connecting groove 35. The lug 38 is provided decentered from the shaft 37, and when the shaft 37 is caused to rotate by an external signal, the control sleeve 34 is caused to move in the direction of the axis of the rotor 8.

In addition, below the control sleeve 34, a retaining groove 39 is formed extending in the axial direction, and a projecting portion of the adapter 11 is retained in the retaining groove 39 to maintain a constant phase relationship between the adapter 11 and the control sleeve 34 at all times.

A timer device 40 is constituted by storing a timer piston 41 slidably in a cylinder provided in the lower portion of the pump housing 2 and linking the timer piston 41 to the cam ring 24 via a lever 42 to adjust the injection timing by converting the movement of the timer piston 41 to rotation of the cam ring 24.

At one end of the timer piston 41, a high pressure chamber into which high pressure fuel in the high pressure fuel range 5*b* is induced is formed, whereas at the other end, a low pressure chamber that communicates with the low pressure fuel range 5*a* is formed. Furthermore, a timer spring is provided in the low pressure chamber and this timer spring applies a constant force to the timer piston 41 toward the high pressure chamber. Consequently, the timer piston 41 stops at the position at which the spring pressure imparted by the timer spring and the pressure of the fuel in the high pressure chamber are in balance, and when the pressure in the high pressure chamber increases, the timer piston 41 moves toward the low pressure chamber against the force imparted by the timer spring to cause the cam ring 24 to rotate in the direction in which the injection timing is hastened, resulting in the injection timing being advanced. On the other hand, when the pressure in the high pressure chamber becomes lower, the timer piston 41 moves toward the high pressure chamber causing the cam ring 24 to rotate in the direction in which the injection timing is delayed to retard the injection timing. It is to be noted that the pressure in the high pressure chamber at the timer is adjusted by a timing control valve (TCV) 43 to achieve the desired timer advance angle.

Figure 2B:
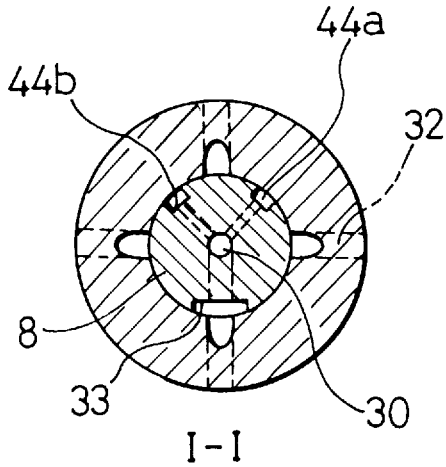
Figure 3A:
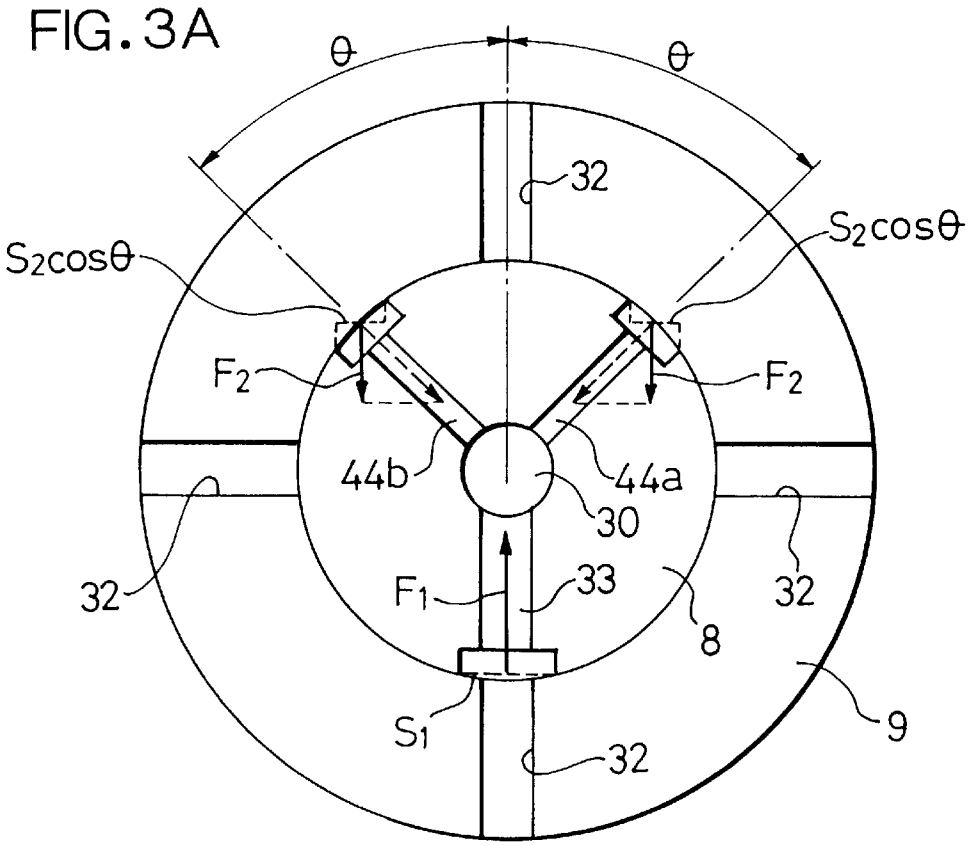
FIG. 3 illustrates the relationship between the distribution port and the balance ports formed at the rotor when there are four fuel delivery passages, with FIG. 3A illustrating a state in which the distribution port communicates with a fuel delivery passage and FIG. 3B illustrating a state in which the balance ports are in communication with fuel delivery passages.
Figure 3B:
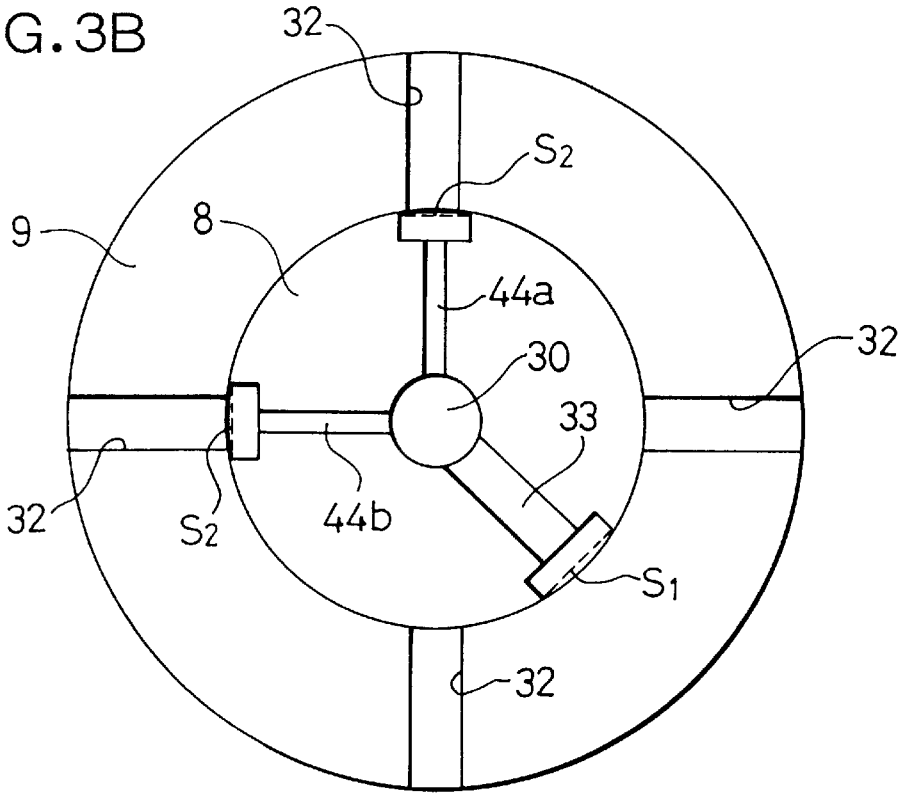

Now, two balance ports, i.e., a first balance port 44*a* and a second balance port 44*b* (indicated as 44 in FIG. 2A) are formed at the rotor 8 in the sliding contact area where the rotor 8 slides in contact with the rotor supporting member 9 as shown in FIG. 2B and FIGS. 3A and 3B. To describe them in detail, the first balance port 44*a* and the second balance port 44*b* are shaped identically to each other with the centers of their opening ends in the axial direction positioned on the same plane that passes through the center of the opening end of the distribution port 33 in the axial direction to extend perpendicular to the axis of the rotor 8. In addition, each of the balance ports 44*a* and 44*b* is structured so that while the opening area at its opening end is set large, the radius is reduced in the area ranging from the longitudinal hole 30 to the opening end compared to the radii of the longitudinal hole 30 and the distribution port 33, to constrict the passage cross section. Moreover, the distribution port 33 and the balance ports 44*a* and 44*b* are all bored in such a manner that they incline from the tail end portion of the longitudinal hole 30 toward their opening ends.

The balance ports 44*a* and 44*b* are formed symmetrically offset relative to the distribution port 33 in the circumferential direction. In other words, these two balance ports 44*a* and 44*b* and the distribution port 33 communicate with each other at the center of the rotor 8, with the phases of the balance ports 44*a* and 44*b* offset in the circumferential direction by the same angle θ relative to a hypothetical plane that intersects the distribution port 33 at the longitudinal hole 30, so that when they are viewed in the axial direction, they form a Y-shape.

In addition, the sum ($2 \cdot S_2 \cdot \cos\theta$) of the areas ($S_2 \cdot \cos\theta$) of the projected surfaces of the opening surfaces of the balance ports 44*a* and 44*b* that are parallel to the opening surface of the distribution port 33 is set to be equal to the opening area ($S_1$) of the distribution port 33 so that a force F, imparted to the rotor 8 by the high pressure fuel flowing into the distribution port 33 and the force $2F_2$ imparted to the rotor 8 by the high pressure fuel flowing into the two balance ports 44*a* and 44*b* in the direction opposite from the direction in which the force $F_1$ is applied are equal to each other.

Moreover, with the balance ports 44*a* and 44*b* provided by setting the angle 2θ between the balance ports at 90° to correspond to the 90° intervals over which the fuel delivery passages are formed in the case of a four cylinder engine, it is ensured that when one balance port comes into communication with a fuel delivery passage, the other balance port also comes into communication with a fuel delivery passage.

In the structure described above, when the rotor 8 rotates, the inflow/outflow port 31 comes into communication with the communicating hole of the control sleeve 34 sequentially and in an intake phase, during which the plungers 20 move away from the compression space 21, the inflow/outflow port 31 and the communicating hole of the control sleeve 34 become aligned to allow the fuel to be taken into the compression space 21 from the fuel chamber 6.

Then, when the operation enters the force feed phase, during which the plungers 20 move toward the center of the cam ring 24, the communication between the inflow/outflow port 31 and the communicating hole of the control sleeve 34 is cut off, the distribution port 33 and one of the fuel delivery passages 32 become aligned and compressed fuel is delivered to a delivery valve 7 via this fuel delivery passage 32. After this, the fuel delivered from the delivery valve 7 is sent to an injection nozzle via an injection pipe (not shown) to be injected into a cylinder of the engine from the injection nozzle.

Since the pressure of the fuel filling the distribution port 33 increases during this force feed phase, the rotor 8 is pressed in the direction of the radius due to the reaction of the pressure of the fuel from the distribution port 33. However, since the pressure of the fuel filling the balance ports 44*a* and 44*b* also increases in a like manner, the force which presses the rotor 16 in a direction of the radius opposite from the direction in which each of the balance ports 44*a* and 44*b* are formed is generated. Since the balance ports 44*a* and 44*b* are formed at the same size symmetrically relative to the distribution port 33 in the direction of the circumference of the rotor and the resultant force of the combined forces generated at the balance ports 44*a* and 44*b* is set equal to the force in the direction of the radius generated at the distribution port 33 ($F_1=2F_2$) with the sum of the areas of the projected surfaces of the opening surfaces of the balance ports that are parallel to the opening surface of the distribution port set equal to the opening area of the distribution port, resulting in the forces canceling each other out, a balanced state is achieved for the rotor 8 in which it operates as though no force were applied in any direction of the radius. Thus, the rotor 8 slides smoothly against the rotor supporting member 9 without becoming distorted in the direction of the radius because of the fuel pressure, preventing seizure between the rotor 8 and the rotor supporting member 9. Furthermore, since the two balance ports 44*a* and 44*b* and the distribution port 33 are formed so that they form a Y-shape when viewed in the axial direction, force is applied in the direction of the radius from the three locations around the rotor, making it possible to achieve a more accurate pressure balance in the direction of the radius.

When, during this force feed phase, the inflow/outflow port 31 and the communicating hole of the control sleeve 34 come into communication with each other, compressed fuel flows out into the fuel chamber 6 to stop delivery of fuel into the injection nozzle, thereby ending the injection.

Then, during the period over which the distribution port 33 is not in communication with a fuel delivery passage, the intake phase restarts and the operation described above is repeated.

During the period over which the distribution port 33 is not in communication with a fuel delivery passage 32, there is a period of time during which the longitudinal hole 30 of the rotor 8 is in communication with the fuel chamber 6 via the inflow/outflow port 31 and the communicating hole of the control sleeve 34, and at this point in time, the balance ports 44*a* and 44*b* come into communication with the two fuel delivery passages 32 which are further away from the distribution port 33. As a result, the pressure in the two fuel delivery passages 32 communicating with the balance ports 44*a* and 44*b* are equalized via the balance ports 44*a* and 44*b*. Furthermore, since the two fuel delivery passages 32 also come into communication with the fuel chamber 6 via the balance ports 44*a* and 44*b*, the longitudinal hole 30, the inflow/outflow port 31 and the communicating hole of the control sleeve 34, the pressure in the two fuel delivery passages 32 communicating with the balance ports 44*a* and 44*b* is set equal to the chamber pressure, thereby establishing a constant initial pressure for the following compression phase in which the distribution port 33 next comes into communication, to achieve consistent, stable injection characteristics.

It is to be noted that it has been confirmed through testing that the presence of the balance ports greatly reduces the incidence of seizure and that the results of the calculation of the distortion of the rotor in the direction of the radius based upon computer simulation, too, indicate that while distortion occurs to an extent more or less equivalent to the size of the clearance set in the sliding contact area of the rotor 8 and the rotor supporting member 9 in a rotor without balance ports, the distortion occurring in the direction of the radius of the rotor is reduced to ⅓–1/4 of the clearance set at the sliding contact area in the structure according to the present invention. Thus, while seizure occurs as a matter of course in a rotor without balance ports since there is no clearance, seizure is almost completely prevented in the structure according to the present invention, since there is sufficient allowance of clearance, thereby eliminating durability-related problems.

Figure 2C:
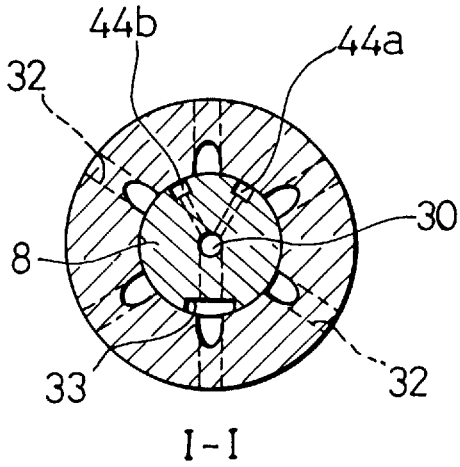
Figure 4A:
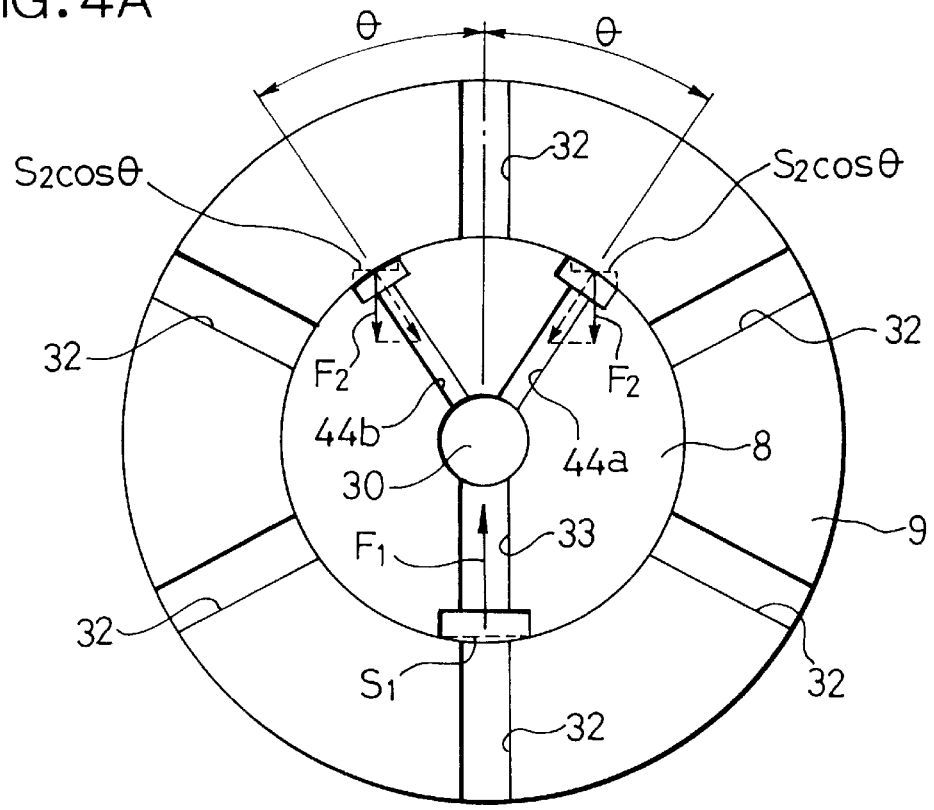
FIG. 4 illustrates the relationship between the distribution port and the balance ports formed at the rotor when there are six fuel delivery passages, with FIG. 4A illustrating a state in which the distribution port communicates with a fuel delivery passage and FIG. 4B illustrating a state in which the balance ports are in communication with fuel delivery passages.
Figure 4B:
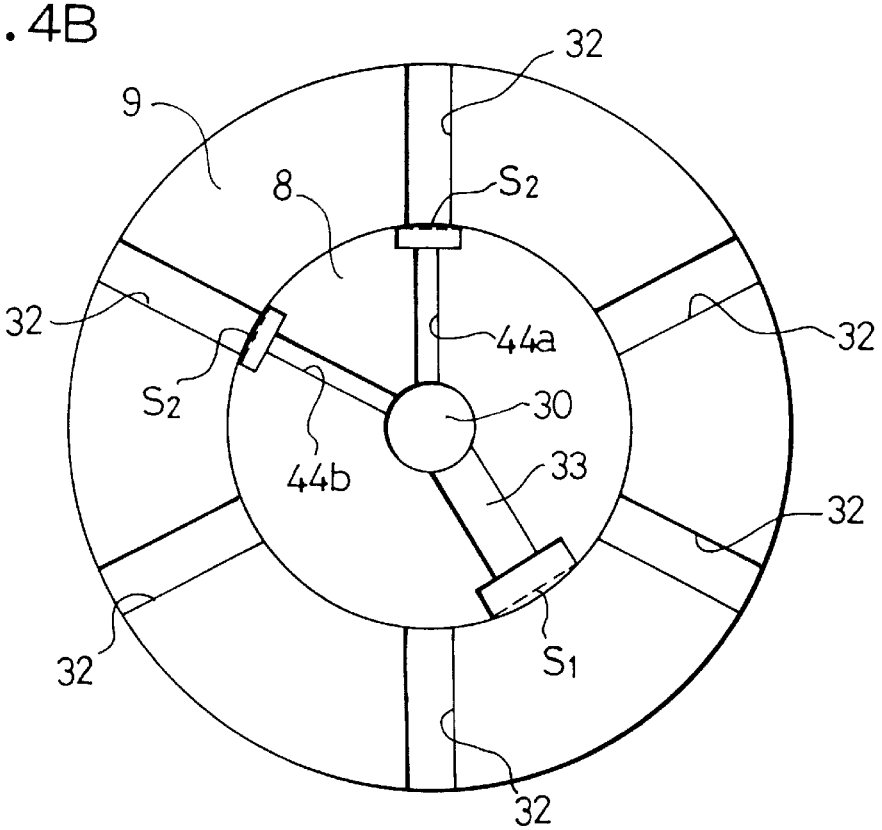

In addition, in the case of a 6-cylinder engine, in which the fuel delivery passages 32 are formed over 60° intervals, as illustrated in FIG. 2C and FIGS. 4A and 4B, the balance ports 44*a* and 44*b* which satisfy the relationship expressed as $S_1=2\cdot S^2\cdot\cos\theta$ should be formed with 2θ set at 60° to achieve a pressure balance. Other structural features are identical to those described earlier. In this structure, too, the forces applied in the direction of the radius of the rotor can be canceled out to assure smooth rotation of the rotor and prevent seizure at the sliding contact surface. Moreover, it goes without saying that advantages identical to those described earlier such as stabilization of the injection characteristics and the like are achieved by using the balance ports 44*a* and 44*b* as pressure equalizing ports.

As has been explained, according to the present invention, since two balance ports are formed symmetrically relative to the distribution port in the circumferential direction, the two balance ports and the distribution port are formed in such a manner that they constitute a Y-shape when viewed from the direction of the axis of the rotor with the opening ends of the balance ports and the opening end of the distribution port positioned on the same plane, which is perpendicular to the axis of the rotor, that when the distribution port is in communication with a fuel delivery passage, the balance ports are not in communication with a fuel delivery passage, and that the sum of the areas of the projected surfaces of the opening surfaces of the individual balance ports that are parallel to the opening surface of the distribution port is set equal to the opening area of the distribution port, the resultant force of the combined forces imparted in the direction of the radius of the rotor generated at the balance ports and the force imparted in the direction of the radius of the rotor generated at the distribution port cancel each other out precisely, to make it possible for the rotor to rotate in a well-balanced state in which it operates as though no pressure were applied in any direction of the radius. As a result, the sliding movement between the rotor and its supporting member becomes smoother, to prevent seizure.

In addition, by setting a phase interval of the fuel delivery passages, which are formed by offsetting the phases of the individual fuel delivery passages, over equal intervals of 90° in the case of a fuel injection pump for a 4-cylinder engine and over equal intervals of 60° in the case of a fuel injection pump for a 6-cylinder engine and the phase internal of the two balance ports equal to each other, the fuel delivery passages are made to communicate with each other via the balance ports to eliminate inconsistency in the residual pressures in the individual fuel delivery passages. Moreover, during a non-injection period, over which the balance ports are in communication with fuel delivery passages, the fuel delivery passages communicating with the balance ports also come into communication with the fuel chamber to set the pressure in the fuel delivery passage equal to the chamber pressure. This prevents the initial pressure within the fuel delivery passages from fluctuating each time they become aligned with the distribution port or the initial pressure from being different from that in the other fuel delivery passages, thereby achieving consistency in the injection characteristics to achieve stable injection.

What is claimed is:

1. A distributor type fuel injection pump having;

a rotor that rotates in synchronization with an engine;

plungers that are slidably provided in a radial direction of said rotor and vary the volumetric capacity of a compression space formed at said rotor; and a cam ring that is provided concentrically around said rotor to cause said plungers to engage in reciprocal movement in said direction of said radius of said rotor, all provided within a housing; wherein:

ports for taking in, distributing and cutting off fuel by coming into communication with said compression space are formed at said rotor;

said port for distributing fuel opens at an area where said rotor slides in contact with a member that supports said rotor and is capable of coming into communication with fuel delivery passages formed at said member supporting said rotor and opening at said area of sliding contact;

balance ports that open at said area of sliding contact and communicate with said compression space are provided at said rotor separately from said port for distributing fuel;

said balance ports comprise two ports that are offset symmetrically relative to said port for distributing fuel in a circumferential direction and said two balance ports and said distribution port are formed to constitute a Y-shape when viewed in the axial direction of said rotor;

opening ends of said balance ports and an opening end of said distribution port are positioned on a plane that is perpendicular to said axis of said rotor and while said distribution port is in communication with one of said fuel delivery passages, said balance ports do not communicate with any of said fuel delivery passages; and an offset angle θ over which said balance ports are offset in said circumferential direction relative to said axis of said distribution port, an opening area $S_1$ of said distribution port and an opening area $S_2$ of each of said balance ports achieve a relationship expressed as $$S_1=|2\cdot S_2\cdot\cos\theta|.$$

2. A distributor type fuel injection pump according to claim 1, wherein:

at said rotor, said compression space and said plungers are provided at a base end to which a rotating motive force is communicated with a front end of said rotor inserted slidably at said supporting member and said balance ports and said port for distributing fuel are made to open at said area where said rotor slides in contact with said supporting member.

3. A distributor type fuel injection pump according to claim 1, wherein:

at each of said balance ports, a cross sectional area is made to increase at an opening end and a passage cross section is constricted over an area toward said opening end.

4. A distributor type fuel injection pump according to claim 1, wherein:

said balance ports and said port for distributing fuel are fluidly connected with said compression space via a hole formed in an axial direction at the center of said rotor.

5. A distributor type fuel injection pump according to claim 4, wherein:

said balance ports and said port for distributing fuel are formed as inclined passages that incline toward said compression space from said opening ends at said area of sliding contact via said hole formed at said center of said rotor.

6. A distributor type fuel injection pump according to claim 1, wherein:

when said fuel delivery passages are formed offset from each other over equal intervals, the phase intervals of said fuel delivery passages and the phase interval between said two balance ports are set equal to each other.

7. A distributor type fuel injection pump according to claim 6, wherein:

four fuel delivery passages are formed over 90° phase intervals and said phase interval between said two balance ports is also 90°.

8. A distributor type fuel injection pump according to claim 6, wherein:

six fuel delivery passages are formed over 60° phase intervals and said phase interval between said two balance ports is also 60°.

9. A distributor type fuel injection pump according to claim 1, wherein:

said two balance ports are formed in identical shapes.

10. A distributor type fuel injection pump according to claim 1, wherein:

a control sleeve is externally fitted at said rotor slidably; and said ports for taking in and distributing fuel formed at said rotor open at said area of sliding contact which is covered by said control sleeve.

11. A distributor type fuel injection pump according to claim 1, wherein:

said ports for taking in and distributing fuel formed at said rotor are structured as common ports.

* * * * *